US009790564B2

(12) United States Patent
Hwang et al.

(10) Patent No.: US 9,790,564 B2
(45) Date of Patent: Oct. 17, 2017

(54) HEAT TREATMENT APPARATUS FOR HOT STAMPING AND FORMING METHOD USING THE SAME

(71) Applicant: HYUNDAI MOTOR COMPANY, Seoul (KR)

(72) Inventors: Jae Ryeon Hwang, Ulsan (KR); Byung Hun Kim, Ulsan (KR); Jong Ho Maeng, Seoul (KR); Jang Choon Park, Ulsan (KR); Heong Joo Park, Ulsan (KR)

(73) Assignee: Hyundai Motor Company, Seoul (KR)

( * ) Notice: Subject to any disclaimer, the term of this patent is extended or adjusted under 35 U.S.C. 154(b) by 446 days.

(21) Appl. No.: 14/522,148

(22) Filed: Oct. 23, 2014

(65) Prior Publication Data

US 2015/0344986 A1 Dec. 3, 2015

(30) Foreign Application Priority Data

May 29, 2014 (KR) ..... 10-2014-0065256

(51) Int. Cl.

| | |
|---|---|
| ***C21D 8/00*** | (2006.01) |
| ***B21D 37/16*** | (2006.01) |
| ***B21J 5/02*** | (2006.01) |
| ***B21J 9/00*** | (2006.01) |
| ***B21J 13/02*** | (2006.01) |
| ***C21D 1/40*** | (2006.01) |
| ***B21D 22/20*** | (2006.01) |
| ***C21D 1/673*** | (2006.01) |

(52) U.S. Cl.

CPC ..... *C21D 8/005* (2013.01); *B21D 22/208* (2013.01); *B21D 37/16* (2013.01); *B21J 5/027* (2013.01); *B21J 9/00* (2013.01); *B21J 13/02* (2013.01); *C21D 1/40* (2013.01); *C21D 1/673* (2013.01)

(58) Field of Classification Search

CPC ..... B22D 37/16; B22D 22/208
USPC ..... 72/342.1
See application file for complete search history.

(56) References Cited

U.S. PATENT DOCUMENTS

| | | | | |
|---|---|---|---|---|
| 3,584,487 | A * | 6/1971 | Carlson | B21D 37/16 219/650 |
| 2010/0269559 | A1* | 10/2010 | Ishiguro | C21D 1/673 72/342.1 |
| 2014/0096583 | A1* | 4/2014 | Cho | B21D 22/208 72/332 |
| 2014/0260493 | A1* | 9/2014 | Yoon | B21D 37/16 72/342.5 |
| 2015/0344986 | A1* | 12/2015 | Hwang | C21D 1/673 148/566 |
| 2016/0279731 | A1* | 9/2016 | Hwang | B23K 11/3009 |

FOREIGN PATENT DOCUMENTS

| | | |
|---|---|---|
| JP | 2000-343139 A | 12/2000 |
| JP | 2014-087837 A | 5/2014 |
| KR | 10-0902857 B1 | 6/2009 |

* cited by examiner

*Primary Examiner* — Scott Kastler
(74) *Attorney, Agent, or Firm* — McDermott Will & Emery LLP

(57) ABSTRACT

A heat treatment apparatus for hot stamping includes a frame, and heating units provided to be vertically movable at both upper and lower sides of the frame and configured to heat a cold formed steel plate by electrifying the steel plate. Cooling units are provided to be vertically movable at centers of the upper and lower sides of the frame and are configured to cool the heated steel plate while pressurizing the steel plate from upper and lower sides.

17 Claims, 8 Drawing Sheets

HEAT TREATMENT APPARATUS FOR HOT STAMPING AND FORMING METHOD USING THE SAME

CROSS-REFERENCE TO RELATED APPLICATION

The present application claims the benefit of priority to Korean Patent Application Number 10-2014-0065256 filed on May 29, 2014, the entire contents of which application are incorporated herein for all purposes by this reference.

TECHNICAL FIELD

The present disclosure relates to a heat treatment apparatus for hot stamping and a forming method using the same, and more particularly, to a heat treatment apparatus for hot stamping, by which heating and cooling operations are sequentially performed in the same apparatus to secure high strength of a cold-formed steel plate, and a forming method using the same.

BACKGROUND

In general, various efforts for reducing the vehicle weight and improving safety during a collision have been exerted in an automobile industry.

A hot stamping technology using a boron steel plate has been actively developed in order to satisfy both weight and rigidity of the vehicle body.

The hot stamping technology is a method of heating (900° C. to 950° C.) the boron steel plate in a separate heating furnace, press forming the heated steel plate, and then rapidly cooling the press formed steel plate in a mold to manufacture a high strength component of 1500 MPa or more through a phase transformation to martensite.

A method of first cold forming a boron steel plate, heating (900° C. to 950° C.) the formed steel plate in a separate heating furnace, and then rapidly cooling the heated steel plate in a separate cooling mold to manufacture a vehicle body component having high strength of 1500 MPa or more through a phase transformation to martensite is also used.

However, an installation space is limited in the hot stamping technology because the heating furnace having a length of about 25 m is necessarily installed, and the manufacturing time of the hot stamping technology is excessively taken because the steel plate before forming or the formed steel plate is heated while passing through the heating furnace.

Further, since the heating operation and the cooling operation of the steel plate are performed in the separate heating furnace, the cost is unnecessarily consumed.

The aforementioned drawbacks cause degradation of general productivity of the high strength component.

The above information disclosed in this Background section is only for enhancement of understanding of the background of the invention, and therefore, it may contain information that does not form the prior art that is already known in this country to a person of ordinary skill in the art.

SUMMARY

The present disclosure has been made in an effort to provide a heat treatment apparatus for hot stamping, by which heating and cooling operations are sequentially performed in the same apparatus so as to achieve high strength of a cold-formed steel plate, and a forming method using the same.

According to an exemplary embodiment of the present invention, a heat treatment apparatus for hot stamping includes a frame, and heating units provided to be vertically movable at both upper and lower sides of the frame and configured to heat a cold formed steel plate by electrifying the steel plate. Cooling units are provided to be vertically movable at centers of the upper and lower sides of the frame and configured to cool the heated steel plate while pressurizing the steel plate from upper and lower sides.

The heating units may include first and second upper electrodes installed at the upper sides of the frame, respectively, and vertically moving according to operations of first actuators. First and second lower electrodes are installed at the lower sides of the frame to correspond to the first and second upper electrodes, respectively.

The first and second upper electrodes may have different polarities.

The first and second lower electrodes may have different polarities.

The first and second lower electrodes may support both ends of a bottom surface of the steel plate. The first and second upper electrodes may electrify the steel plate while pressurizing both ends of an upper surface of the steel plate.

The first and second lower electrodes may be fixedly installed on the frame.

The first and second upper electrodes may have a shape corresponding to an upper end of the steel plate. The first and second lower electrodes may have a shape corresponding to a lower end of the steel plate.

The upper electrode and lower electrodes may be horizontally movable.

The heating units may be provided to be horizontally movable from both sides of the frame.

The heating units may be cooled by heat exchange with the cooling units.

The first actuators may be installed at the upper sides of the first and second upper electrodes, respectively, to be vertical with the frame, and the operating rods may be configured with first cylinders connected with the first and second upper electrodes.

The cooling units may include an upper mold provided at a center of an upper side of the frame, and connected with a second actuator installed at the upper side to vertically move. A lower mold is provided at a center of a lower side of the frame to correspond to the upper mold, and connected with a third actuator installed at the lower side to vertically move. Cooling channels, in which coolant is circulated, may be formed in each of the upper mold and the lower mold.

The upper mold may be disposed between the first and second upper electrodes, and the lower mold may be disposed between the first and second lower electrodes.

The second actuator may include a second cylinder provided at an upper side of the upper mold to be vertical to the frame. An upper mold holder connects the second cylinder and the upper mold through an upper operating rod at a lower side of the second cylinder. Upper mold guiders are vertically provided at an external side of the second cylinder, and guide vertical movement of the upper mold holder and the upper mold according to an operation of the second cylinder.

The third actuator may include a third cylinder provided at a lower side of the lower mold to be vertical to the frame. A lower mold holder connects the third cylinder and the lower mold through a lower operating rod at an upper side of the third cylinder. Lower mold guiders are vertically provided at an external side of the third cylinder, and guide vertical movement of the lower mold holder and the lower mold according to an operation of the third cylinder.

The cooling channels may be formed inside the upper mold corresponding to a shape of the upper end of the steel plate, and formed inside the lower mold according to the shape of the surface of the lower end of the steel plate.

According to another exemplary embodiment of the present invention, a hot stamping forming method includes (a) providing a steel plate cut from a steel sheet; (b) cold forming the steel plate to a shape corresponding to a finish product; (c) trimming and piercing the cold formed steel plate; (d) transforming a phase by heating and cooling the trimmed steel plate in the same apparatus; and (e) extracting the phase transformed steel plate.

In step (d), a heat treatment apparatus for hot stamping includes a frame and heating units provided to be vertically movable at both upper and lower sides of the frame, and configured to heat the cold formed steel plate by electrifying the steel plate. Cooling units are provided to be vertically movable at centers of the upper and lower sides of the frame, and configured to cool the heated steel plate while pressurizing the steel plate from upper and lower sides.

In step (d), lower electrodes of the heating units may support both lateral parts of a bottom surface of the steel plate. Upper electrodes of the heating units may pressurize an upper side of the steel plate. The upper and lower electrodes may heat the steel plate and simultaneously electrify each other.

In step (d), in a state where the steel plate is heated, the upper mold and the lower mold of the cooling units may be combined and the heated steel plate may be cooled by cooling channels formed inside the combined upper and lower molds.

DETAILED DESCRIPTION

Figure 1:
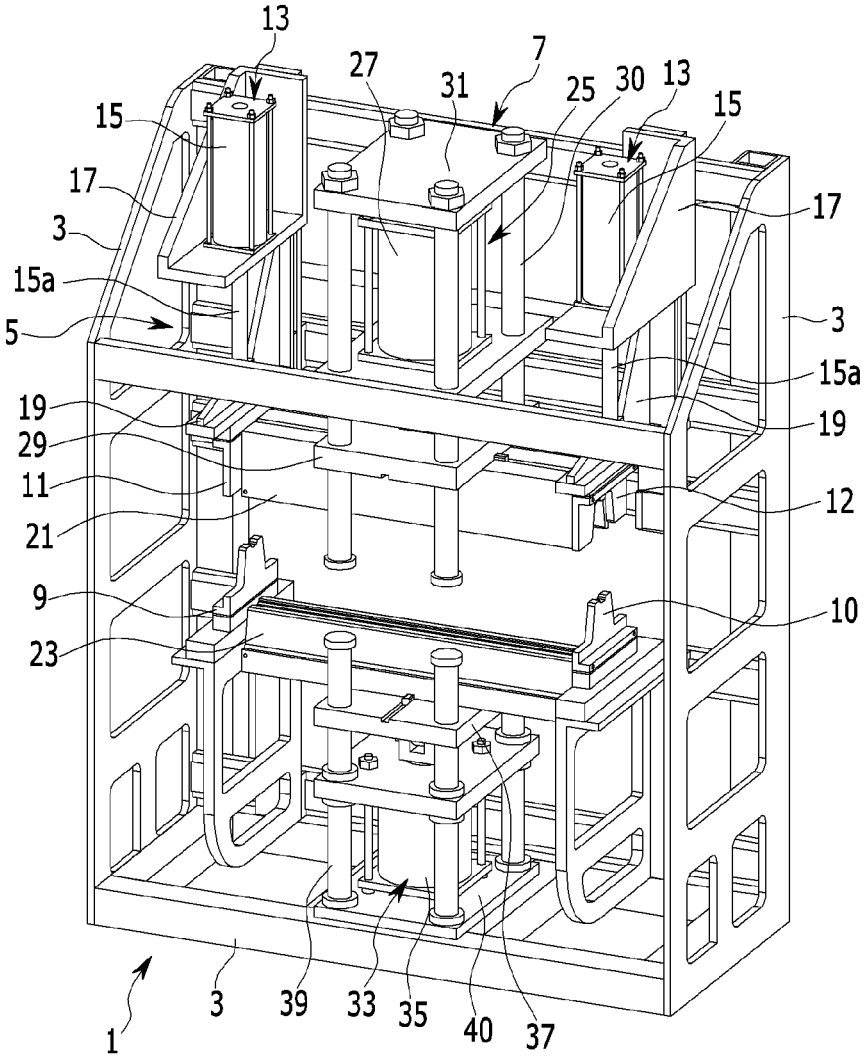
FIG. 1 is a perspective view illustrating a heat treatment apparatus for hot stamping according to an exemplary embodiment of the present invention.

Hereinafter, an exemplary embodiment of the present invention will be described with reference to the accompanying drawing in detail.

However, the size and thickness of each configuration shown in the drawings are arbitrarily shown for understanding and ease of description, but the present invention is not limited thereto, and the thicknesses of portions, regions, etc., are exaggerated for clarity.

Further, a part irrelevant to the description is omitted for clarity of the exemplary embodiment of the present invention, and in a description below, names of constituent elements are discriminatingly used as "a first . . . ," a second . . . ," and the like, but this is for discriminating the same name of the constituent element, and the name of the constituent element is not limited to the order.

A heat treatment apparatus for hot stamping according to an exemplary embodiment of the present invention is installed in a hot stamping system to heat and cool a cold formed steel plate in the same apparatus to achieve high strength of the formed steel plate.

The heat treatment apparatus for hot stamping may cold-form a boron steel plate having an excellent heat treatment property, and heat-treat and cool the cold formed steel plate to manufacture a vehicle body component with high strength of 1500 MPa or greater.

Here, examples of the vehicle body component include a collision member, such as a center pillar, a roof rail, a bumper, and an impact beam.

Figure 2:
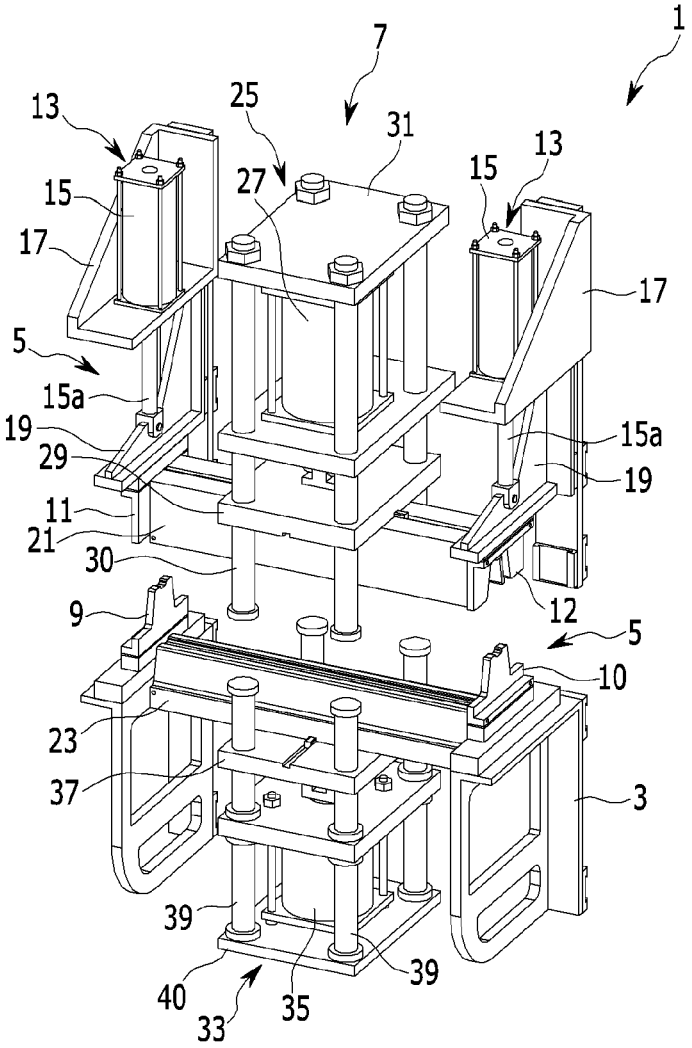
FIG. 2 is a front view of the heat treatment apparatus for hot stamping according to the exemplary embodiment of the present invention.
Figure 3:
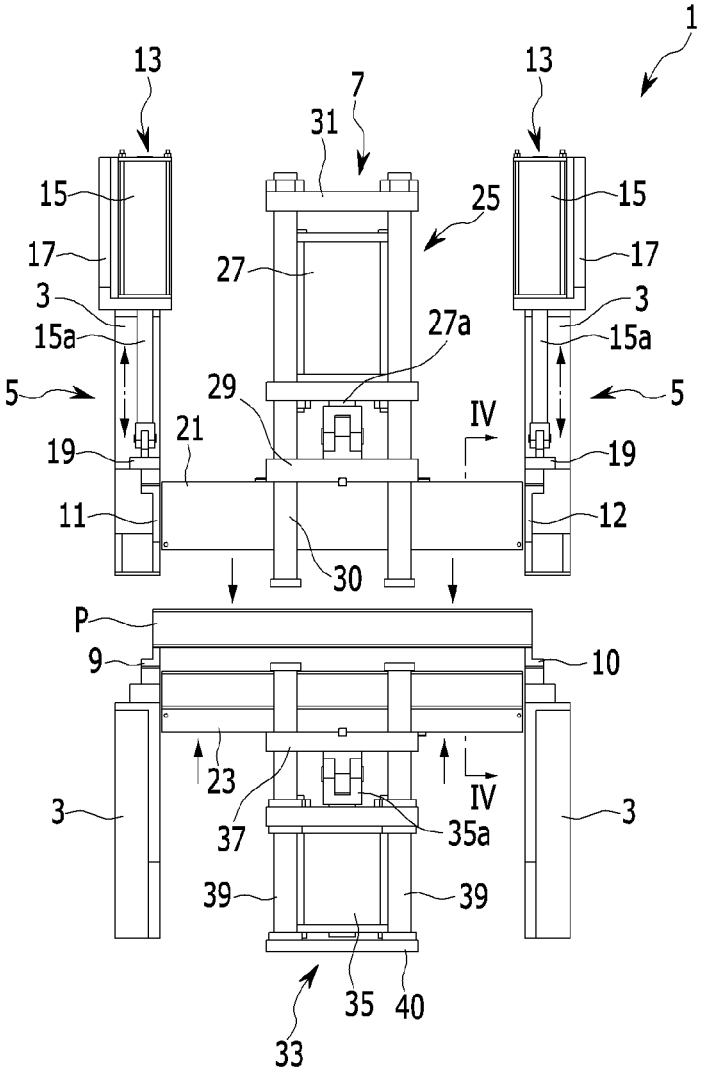
FIG. 3 is a front view of the heat treatment apparatus for hot stamping according to the exemplary embodiment of the present invention.

FIG. 1 is a perspective view illustrating a heat treatment apparatus for hot stamping according to an exemplary embodiment of the present invention. FIG. 2 is a perspective view of the heat treatment apparatus for hot stamping according to the exemplary embodiment of the present invention, except for a part of a frame. FIG. 3 is a front view of the heat treatment apparatus for hot stamping according to the exemplary embodiment of the present invention.

Referring to FIGS. 1 to 3, a heat treatment apparatus 1 for hot stamping according to the exemplary embodiment of the present invention includes a frame 3, heating units 5, and cooling units 7.

The frame 3 serves as a general outer frame of the heat treatment apparatus 1 for hot stamping according to the exemplary embodiment of the present invention, and a plurality of frames 3 are connected with each other.

The frame 3 may have a plate shape or the like, and various types and forms may be used for the frame 3.

The heating units 5 are installed to be vertically movable at both upper and lower sides of the frame 3 and to heat a steel plate P, which is cold formed in a shape as a finish product and inserted into the heat treatment apparatus 1 for hot stamping, at about 900° C. while allowing a current flow in the steel plate P.

The cooling units 7 are installed to be vertically movable in a center of the upper and lower sides of the frame 3, respectively and to rapidly cool the heated steel plate P by the heating units 5 to a predetermined temperature.

The formed steel plate P subjected to the heating and cooling processes through the heating units 5 and the cooling units 7 has high strength of 1500 MPa or greater through a phase transformation.

Hereinafter, each heating unit 5 and cooling unit 7 will be described in more detail.

The heating unit 5 includes first and second lower electrodes 9 and 10, and first and second upper electrodes 11 and 12. The first and second lower electrodes 9 and 10 are fixedly installed at both sides of the lower side of the frame 3, respectively, and support both ends of a bottom surface of the steel plate P. In this case, the first and second lower electrodes 9 and 10 have a shape of a lower end surface of the steel plate P.

The first and second lower electrodes 9 and 10 have different polarities. That is, a polarity of the first lower electrode 9 may be positive (+), and a polarity of the second lower electrode 10 may be negative (−).

The first and second lower electrodes 9 and 10 are fixedly installed in the frame 3, but installation positions of the first and second lower electrodes 9 and 10 on the frame 3 may be varied. That is, the installation positions of the first and second lower electrodes 9 and 10 are changed to left and right sides with respect to the frame 3 according to a size of the steel plate P to correspond to the size of the steel plate P.

The first and second upper electrodes 11 and 12 are installed at both sides of the upper side of the frame 3 to correspond to the first and second lower electrodes 9 and 10 and to vertically move according to an operation of a first actuator 13.

The first and second upper electrodes 11 and 12 are electrified with the first and second lower electrodes 9 and 10 while pressurizing both ends of an upper surface of the steel plate P and heating the steel plate P. In this case, the first and second upper electrodes 11 and 12 have a shape of an upper end surface of the steel plate P.

The first and second upper electrodes 11 and 12 have different polarities. That is, a polarity of the first upper electrode 11 may be positive (+), and a polarity of the second upper electrode 12 may be negative (−).

Further, the first and second upper electrodes 11 and 12 may be installed to be movable in a horizontal direction with respect to the frame 3. That is, the installation positions of the first and second upper electrodes 11 and 12 may be changed to left and right sides with respect to the frame 3 according to the size of the steel plate P, and in this case, the installation positions correspond to the positions of the first and second lower electrodes 9 and 10 for electricity connection.

The first and second lower electrodes 9 and 10 and the first and second upper electrodes 11 and 12 may be replaced and used according to the shape of the cold formed steel plate P.

The first actuators 13 are formed of first cylinders 15 installed at upper sides of the first and second upper electrodes 11 and 12, respectively.

The first cylinders 15 are fixedly installed in a vertical direction through fixing brackets 17 connected with the frame 3, and operating rods 15*a* are connected with the first and second upper electrodes 11 and 12. In this case, moving brackets 19 may be provided between the operating rods 15*a* and the first and second upper electrodes 11 and 12.

The upper sides of the moving brackets 19 are connected with front ends of the operating rods 15*a*, and lower sides thereof are connected with the first and second upper electrodes 11 and 12 to connect the first cylinders 15 and the first and second upper electrodes 11 and 12. In this case, the first cylinder 15 may be formed of any one selected from a hydraulic cylinder and an air pressure cylinder.

According to the first actuator 13, the first cylinder 15 is operated and the operating rods 15*a* move downward, so that the first and the second upper electrodes 11 and 12 pressurize the steel plate P and are electrified with the first and second lower electrodes 9 and 10.

The installation positions of the first and second lower electrodes 9 and 10 and the first and second upper electrodes 11 and 12 are changed to the left and right sides with respect to the frame 3, but the general installation positions of the heating units 5 may be changed. That is, the installation positions of the heating units 5 installed at both sides of the frame 3, respectively, may be changed to the left and right sides with respect to the frame 3 according to the size of the steel plate P. Accordingly, the heating units 5 may heat the steel plate P while considering the size of the cold formed steel plate P.

The cooling unit 7 includes an upper mold 21 and a lower mold 23 in which cooling channels 20 are formed, respectively.

The upper mold 21 is installed at a center of an upper side of the frame 3, that is, a space between the first and second upper electrodes 11 and 12, and is connected with the second actuator 25 installed in an upper direction to vertically move at an upper side of the cold formed steel plate P.

In this case, the upper mold 21 has a shape of the upper end surface of the steel plate P and pressurizes an outer circumference of the upper surface of the steel plate P according to an operation of the second actuator 25.

The second actuator 25 which vertically moves the upper mold 21 includes a second cylinder 27, an upper mold holder 29, and an upper mold guider 30. The second cylinder 27 is vertically installed in the upper side of the upper mold 21 through the frame 3. In this case, the second cylinder 27 may be formed of any one selected from a hydraulic cylinder and an air pressure cylinder.

The upper mold holder 29 connects the second cylinder 27 and an upper end surface of the upper mold 21, and is connected with a front end of an upper operating rod 27*a* in the lower side of the second cylinder 27, and is connected with an upper surface of the upper mold 21.

The plurality of upper mold guiders 30 are vertically provided at an external side of the second cylinder 27, and one side of the upper mold guider 30 is fixed to the second cylinder 27 through a first fixing plate 31, and the other side thereof passes through the upper mold holder 29. Accordingly, the upper mold holder 29 and the upper mold 21 vertically move along the upper mold guiders 30 when the second cylinder 27 operates.

The lower mold 23 is installed at a center of a lower side of the frame 3, that is, a space between the first and second lower electrodes 9 and 10, so as to correspond to the upper mold 21, and is connected with a third actuator 33 installed at the lower side to vertically move under the steel plate P. In this case, the lower mold 23 has a shape of the lower end surface of the steel plate P and pressurizes an outer circumference of the bottom surface of the steel plate P according to an operation of the third actuator 33. The upper mold 21 and the lower mold 23 may be replaced and used according to the shape of the cold formed steel plate P.

The third actuator 33 which vertically moves the lower mold 23 includes a third cylinder 35, a lower mold holder 37, and a lower mold guider 39.

The third cylinder 35 is vertically installed under the lower mold 23 through the frame 3, that is, at the same center as that of the second cylinder 27. In this case, the third cylinder may be formed of any one selected from a hydraulic cylinder and an air pressure cylinder.

The lower mold holder 37 connects the third cylinder 35 and a bottom surface of the lower mold 23, is connected with a lower operating rod 35*a* in the lower side of the third cylinder 35, and is connected with a bottom surface of the lower mold 23.

The plurality of lower mold guiders 39 are vertically provided at an external side of the third cylinder 35. One side of the lower mold guider 39 is fixed to the third cylinder 35 through a second fixing plate 40, and the other side thereof passes through the lower mold holder 37. Accordingly, the lower mold holder 23 and the lower mold holder 37 vertically move along the lower mold guiders 39 when the third cylinder 35 operates.

Figure 4:
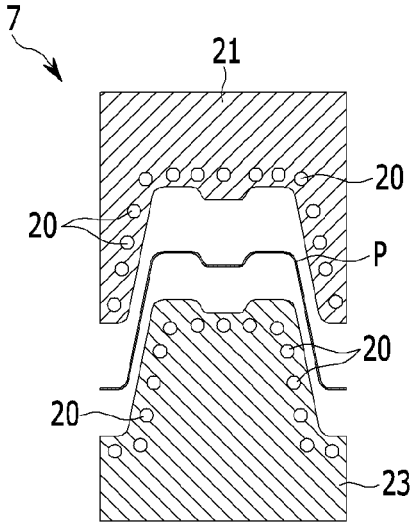
FIG. 4 is an enlarged cross-sectional view taken along line IV-IV of FIG. 3.

FIG. 4 is an enlarged cross-sectional view taken along line IV-IV of FIG. 3.

Referring to FIG. 4, the plurality of cooling channels 20 may be formed inside the upper mold 21 according to the shape of the surface of the upper end of the steel plate P, and the plurality of cooling channels 20 may be formed inside the lower mold according to the shape of the surface of the lower end of the steel plate P. Accordingly, it is possible to rapidly cool the upper mold 21 and the lower mold 23 while coolant is circulated in the cooling channels 20.

According to the cooling unit 7 and the operation of the second and third actuators 25 and 33, the upper mold 21 and the lower mold 23 may rapidly cool the steel plate P while pressurizing the steel plate P heated through the heating units 5 from the upper and lower sides.

Accordingly, the cold formed steel plate P may achieve high strength of 1500 MPa or greater through a phase transformation while passing through the heating and cooling processes, and a spring back phenomenon may be reduced during the process.

The spring back is naturally reduced during the heating and cooling processes of the cold formed steel plate P, a detailed description of which will be omitted.

The heating unit 5 may be cooled during the process of cooling the steel plate P by the cooling units 7. That is, the heating units 5 may be cooled while exchanging heat through the upper mold 21 installed between the first and second upper electrodes 11 and 12 and the lower mold 23 installed between the first and second lower electrodes 9 and 10.

Accordingly, it is possible to prevent the heating units 5 from being damaged due to heat generated during the electrification of the first and second lower electrodes 9 and 10 and the first and second upper electrodes 11 and 12.

Hereinafter, an operation of the heat treatment apparatus 1 for hot stamping including the aforementioned configuration will be described with reference to FIGS. 5 to 8.

Figure 5:
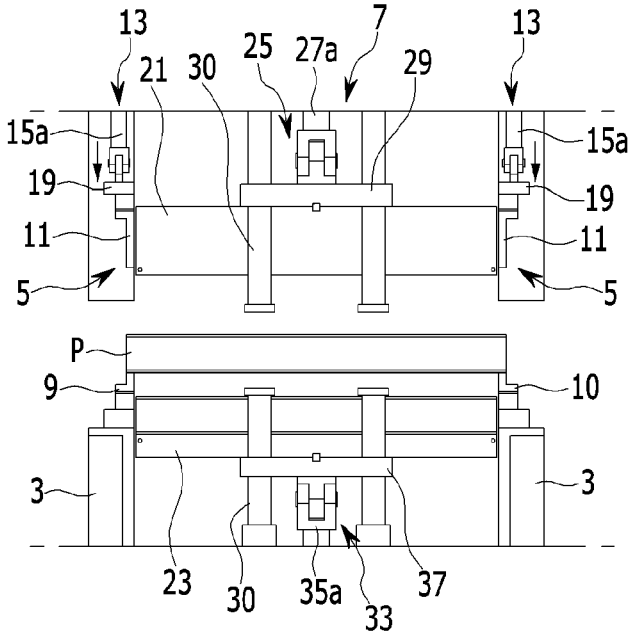
FIGS. 5 to 7 are views illustrating an operation state of the heat treatment apparatus for hot stamping according to the exemplary embodiment of the present invention.
Figure 6:
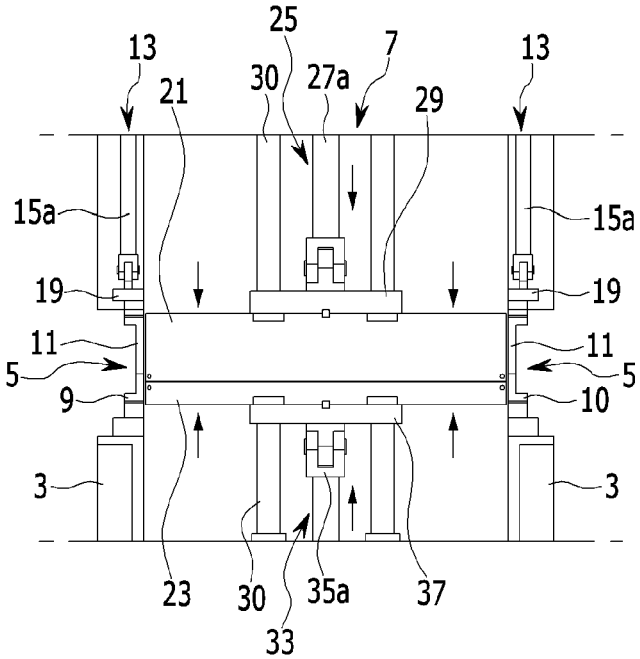
Figure 7:
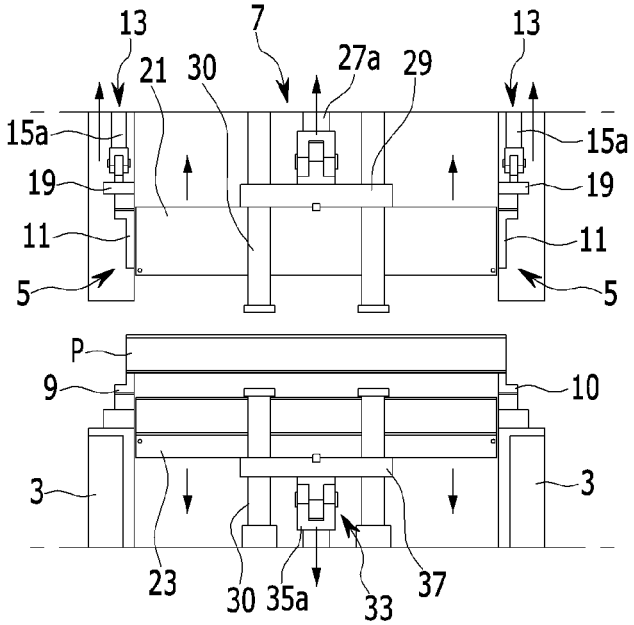

FIGS. 5 to 7 are views illustrating an operation state of the heat treatment apparatus for hot stamping according to the exemplary embodiment of the present invention.

First, the cold formed steel plate P is inserted into the first and second lower electrodes 9 and 10 of the heating units 5 in the state of FIG. 3.

In this case, the upper mold 21 of the cooling unit 7 is positioned at an upper side of the steel plate P, and the lower mold 23 is disposed at a lower side of the steel plate P.

Hereinafter, referring to FIG. 5, when the first actuators 13 operates, the first and second upper electrodes 11 and 12 of the heating units 5 pressurize the steel plate P while moving down, and are electrified with the first and second lower electrodes 9 and 10. In this case, the first and second lower electrodes 9 and 10 are electrified with the first and second upper electrodes 11 and 12 to heat the steel plate P.

When the steel plate P is heated to a predetermined temperature as described above, the cooling units 7 are operated in order to rapidly cool the heated steel plate P.

Referring to FIG. 6, in the cooling units 7, the upper mold 21 and the lower mold 23 pressurize an external circumference of the heated steel plate P while the second and third actuators 25 and 33 are operated.

In this case, the coolant is circulated in the cooling channels 20 of the upper mold 21 and the lower mold 23 to rapidly cool the heated steel plate P to a predetermined temperature.

Then, referring to FIG. 7, the cooling operation is terminated, and simultaneously, the upper mold 21 and the lower mold 23 move to the upper and lower sides of the steel plate P, respectively, by a reverse directional operation of the second and third actuators 25 and 33.

Further, the first and second upper electrodes 11 and 12 of the heating units 5 also move to the upper side of the steel plate P by a reverse directional operation of the first actuator 13.

The steel plate P is then extracted to the outside by using a robot and the like in a state where a bottom surface thereof is supported by the first and second lower electrodes 9 and 10, and thus, the operation ends.

Accordingly, in the heat treatment apparatus 1 for hot stamping according to the exemplary embodiment of the present invention, the heating and cooling operations are continuously performed in the same apparatus so as to achieve high strength of the cold formed steel plate P, thereby reducing an operation time for achieving superhigh strength and improving general productivity.

Further, it is not necessary to move the steel plate to another apparatus for heating and cooling, thereby minimizing heat loss and further reducing an operation time.

A heating furnace and a cooling apparatus for heating and cooling the steel plate P in the related art may be omitted, thereby reducing equipment cost and efficiently using a space.

An operation of securing high strength may be performed after a general trimming operation is performed on the cold formed steel plate P, so that it is possible to remove a laser trimming operation of the superhigh strength steel plate.

A hot stamping forming method using the heat treatment apparatus 1 for hot stamping according to the exemplary embodiment of the present invention including the aforementioned configuration will be described with reference to the above-mentioned drawings and the accompanying drawings in detail.

Figure 8:
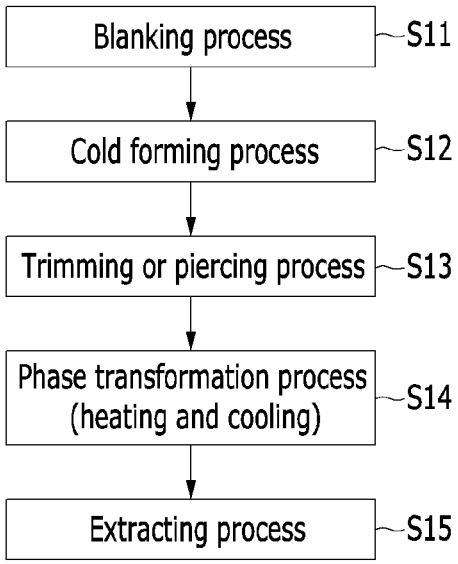
FIG. 8 is a flowchart illustrating a hot stamping forming method according to an exemplary embodiment of the present invention.

FIG. 8 is a flowchart illustrating a hot stamping forming method according to an exemplary embodiment of the present invention.

Referring to FIG. 8 together with FIGS. 1 to 7, in the exemplary embodiment of the present invention, a steel plate obtained by cutting a steel sheet shaped like a coil to have a size available for press forming is provided (S11).

Here, examples of the steel sheet include a cold steel sheet, a hot steel sheet, a galvanized cold steel sheet, an Al—Si boron added coated steel sheet.

In the blanking process (S11), the steel plate is prepared so as to have a relatively greater set weight than that of a final product.

Here, when the weight of the steel plate is smaller than the set weight, that is, the steel plate held by press equipment is insufficient, so that the steel plate may not be completely formed, and when the weight of the steel plate is greater than the set weight, waste of a material is increased, thereby increasing the production cost.

It is described that the steel plate having the greater set weight than the weight of the final product is provided, but the present disclosure is not essentially limited thereto, and a steel plate having a size with a surplus portion exceeding the size of the final product, which serves as a reference, may be provided.

Then, in the exemplary embodiment of the present invention, the steel plate is cold formed in a shape corresponding to the finish product through a press apparatus (S12).

Next, in the exemplary embodiment of the present invention, the cold formed steel plate P in the shape corresponding to the finish product is processed through a trimming apparatus or a piercing apparatus (S13). In this case, a general trimming operation is performed on the cold formed steel plate P, so that a laser trimming operation of the steel plate having the achieved high strength, which is performed as the last process, may be removed.

Then, in the exemplary embodiment of the present invention, a process of transforming a phase is performed while heating and cooling the trimming processed steel plate P (S14). In the phase transformation process (S14), the heat treatment apparatus 1 for hot stamping including the frame 3 and the heating units 5, which are vertically movably installed at both upper and lower sides of the frame 3 and heat the cold formed steel plate P by electrifying the cold formed steel plate P, may be provided.

Further, the heat treatment apparatus 1 for hot stamping includes the cooling units 7 installed to be vertically movable at centers of the upper and lower sides of the frame 3, and cooling the heated steel plate P while pressurizing the steel plate P from upper and lower sides (see FIGS. 1 to 3).

Accordingly, the lower electrodes 9 and 10 of the heating units 5 support both lateral parts of the bottom surface of the steel plate P, the upper electrodes 11 and 12 of the heating units 5 pressurize the upper side of the steel plate P, and the upper electrodes 11 and 12 and the lower electrodes 9 and 10 heat the steel plate P while being electrified with each other (see FIG. 5).

The upper mold 21 and the lower mold 23 of the cooling units 7 are combined at the upper side and the lower side of the steel plate P, and the heated steel plate P is rapidly cooled through the cooling channels 20 formed inside the combined upper mold 21 and lower mold 23, so that the cold formed steel plate P is phase transformed into a martensite structure and high strength of the steel plate is secured (see FIG. 6).

Finally, in the exemplary embodiment of the present invention, the steel plate P with the secured superhigh strength is extracted from the heat treatment apparatus 1 for hot stamping to the outside through a robot (S15).

According to the hot stamping forming method according to the exemplary embodiment of the present invention including the series of processes, the operations of heating and cooling the cold formed steel plate P so as to have high strength are sequentially performed in the heat treatment apparatus 1 for hot stamping, thereby reducing an operation time for securing superhigh strength and improving general productivity.

Further, it is not necessary to move the steel plate P to separate apparatuses for heating and cooling, thereby performing the heating operation while minimizing heat loss and further reducing the operation time.

A heating furnace and a cooling apparatus installed for heating and cooling the steel plate P in the related art may be omitted, thereby reducing the equipment cost and efficiently using an installation space.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A heat treatment apparatus for hot stamping, comprising:

a frame;

heating units provided to be vertically movable at both upper and lower sides of the frame, and configured to heat a cold formed steel plate by electrifying the steel plate; and cooling units provided to be vertically movable at centers of the upper and lower sides of the frame, and configured to cool the heated steel plate while pressurizing the steel plate from upper and lower sides, wherein the heating units include:

first and second upper electrodes installed at the upper sides of the frame, respectively, and vertically moving according to operations of first actuators; and first and second lower electrodes installed at the lower sides of the frame to correspond to the first and second upper electrodes, respectively, and wherein the first and second upper electrodes and the first and second lower electrodes are provided to be horizontally movable.

2. The heat treatment apparatus of claim 1, wherein the first and second upper electrodes have different polarities.

3. The heat treatment apparatus of claim 1, wherein the first and second lower electrodes have different polarities.

4. The heat treatment apparatus of claim 1, wherein the first and second lower electrodes support both ends of a bottom surface of the steel plate, and the first and second upper electrodes electrify the steel plate while pressurizing both ends of an upper surface of the steel plate.

5. The heat treatment apparatus of claim 1, wherein the first and second lower electrodes are fixedly mounted on the frame.

6. The heat treatment apparatus of claim 1, wherein the first and second upper electrodes have a concaved shape corresponding to an upper end of the steel plate, and the first and second lower electrodes have a convex shape corresponding to a lower end of the steel plate.

7. The heat treatment apparatus of claim 1, wherein the heating units are horizontally movable from both sides of the frame.

8. The heat treatment apparatus of claim 1, wherein the heating units are cooled by heat exchange with the cooling units.

9. The heat treatment apparatus of claim 1, wherein the first actuators are installed at upper sides of the first and second upper electrodes, respectively, to be vertical with the frame, and operating rods are connected to first cylinders which are connected with the first and second upper electrodes.

10. The heat treatment apparatus of claim 1, wherein the cooling units include:

an upper mold mounted at a center of an upper side of the frame, and connected with a second actuator installed at the upper side to vertically move; and a lower mold mounted at a center of a lower side of the frame to correspond to the upper mold, and connected with a third actuator installed at the lower side of the frame to vertically move, wherein cooling channels, in which coolant circulates, are formed in each of the upper mold and the lower mold.

11. The heat treatment apparatus of claim 10, wherein the upper mold is disposed between the first and second upper electrodes, and the lower mold is disposed between the first and second lower electrodes.

12. The heat treatment apparatus of claim 10, wherein the second actuator includes:

a second cylinder mounted at an upper side of the upper mold to be vertical on the frame;

an upper mold holder provided to connect the second cylinder and the upper mold through an upper operating rod at a lower side of the second cylinder; and upper mold guiders vertically provided at an external side of the second cylinder, and guiding vertical movement of the upper mold holder and the upper mold according to operations of the second cylinder.

13. The heat treatment apparatus of claim 10, wherein the third actuator includes:

a third cylinder mounted at a lower side of the lower mold to be vertical on the frame;

a lower mold holder provided to connect the third cylinder and the lower mold through a lower operating rod at an upper side of the third cylinder; and lower mold guiders vertically provided at an external side of the third cylinder and guiding vertical movement of the lower mold holder and the lower mold according to operations of the third cylinder.

14. The heat treatment apparatus of claim 10, wherein the cooling channels are formed inside the upper mold according to a concaved shape of an upper end of the steel plate and formed inside the lower mold according to a convex shape of a lower end of the steel plate.

15. A hot stamping forming method, comprising steps of:

(a) providing a steel plate cut from a steel sheet;

(b) cold-forming the steel plate to a shape corresponding to a finish product;

(c) trimming and piercing the cold formed steel plate;

(d) transforming a phase by heating and cooling the trimmed steel plate in the same apparatus; and (e) extracting the phase transformed steel plate, wherein in the step (d), the heat treatment apparatus includes:

frame; and cooling units provided to be vertically movable at centers of the upper and lower sides of the frame, and configured to cool the heated steel plate while pressurizing the steel plate from upper and lower sides, and wherein in step (d), in the state where the steel plate is heated, an upper mold and a lower mold of the cooling units are combined and the heated steel plate is cooled by cooling channels formed inside the combined upper and lower molds.

16. The hot stamping forming method of claim 15, wherein in the step (d), the heat treatment apparatus further includes:

heating units provided to be vertically movable at both upper and lower sides of the frame and configured to heat the cold formed steel plate by electrifying the steel plate.

17. The hot stamping forming method of claim 16, wherein in step (d), lower electrodes of the heating units support both lateral parts of a bottom surface of the steel plate, upper electrodes of the heating units pressurize an upper side of the steel plate, and the upper and lower electrodes heat the steel plate and simultaneously electrify each other.

* * * * *